US008381360B2

(12) United States Patent
Preston-Hall

(10) Patent No.: US 8,381,360 B2
(45) **Date of Patent: *Feb. 26, 2013**

(54) CARD AND CURRENCY CARRYING DEVICE AND METHOD FOR USING SAME

(76) Inventor: Rita Preston-Hall, San Clemente, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/118,327

(22) Filed: May 27, 2011

(65) Prior Publication Data

US 2012/0167356 A1 Jul. 5, 2012

Related U.S. Application Data

(63) Continuation of application No. 12/072,072, filed on Feb. 22, 2008, now Pat. No. 7,971,324.

(51) Int. Cl.
*B65D 63/10* (2006.01)

(52) U.S. Cl. ..... 24/17 B; 24/3.11; 150/900

(58) Field of Classification Search ..... None
See application file for complete search history.

(56) References Cited

U.S. PATENT DOCUMENTS

| | | | | |
|---|---|---|---|---|
| 2,823,723 | A * | 2/1958 | Cohn | 383/43 |
| 5,279,019 | A | 1/1994 | Knickle | |
| 5,367,752 | A | 11/1994 | Petty | |
| D384,499 | S | 10/1997 | Gaestel | |
| 6,205,622 | B1 | 3/2001 | Odishoo | |
| 6,230,878 | B1 | 5/2001 | Lehr | |
| 6,357,084 | B1 | 3/2002 | Haidon | |
| D527,898 | S | 9/2006 | Tavone | |
| 2005/0205435 | A1 | 9/2005 | Loy | |

* cited by examiner

*Primary Examiner* — Jack W. Lavinder
(74) *Attorney, Agent, or Firm* — SoCal IP Law Group LLP; Steven C. Sereboff

(57) ABSTRACT

A card and currency carrying device is shown. The device includes a first side member assembly and a spaced second side member assembly. Each side member assembly has a flexible member, preferably stainless steel, having an undeflected position and a deflected position which is responsive to a compression deflection force applied concurrently to flexible members. A first pair and a second pair of support members are operatively connected to the flexible members. An elastic fabric material, preferably a woven elastic fabric material, having a thickness which reduces in dimension in response to a longitudinal tension force and which maintains its width dimension in response to a longitudinal tension force is operatively connected to the support members.

10 Claims, 5 Drawing Sheets

CARD AND CURRENCY CARRYING DEVICE AND METHOD FOR USING SAME

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX" (SEE 37 CFR 1.96)

Not Applicable

BACKGROUND OF THE INVENTION

1. Field of the Invention

The present invention relates to a card and currency carrying device having a pair of spaced side members for holding and securing at least one item of folded currency and at least one card and more particularly to a first side member assembly and a spaced second side member assembly, each having a flexible member which is responsive to a compression deflection force applied concurrently to the flexible members, a first pair and second pair planar support members enclosing each of the flexible members and an elastic fabric material, preferably a woven, elastic fabric material, having a thickness which reduces in dimension in response to a longitudinal tension force and which maintains its width dimension in response to a longitudinal tension force.

In the preferred embodiment, the card and currency device comprises a pair of spaced deflectable stainless steel spring members responsive to a compression deflection force, two pairs of planar support members operatively connected to and enclosing the pair of spaced deflectable stainless steel spring members and a woven, elastic fabric material having a thickness which reduces in dimension in response to a longitudinal tension force and which maintains its width dimension in response to a longitudinal tension force wherein the woven, elastic fabric material is expanded in response to a compression deflection source being applied to the pair of spaced deflectable stainless steel spring members to enable a user to insert folded currency and/or cards into the device.

2. Description of the Prior Art

Money band and money clips for holding currency and cards, including credit cards, business cards and the like, and devices for wrapping packages or securing bundles are well known in the prior art. The following are illustrative examples of known devices.

One example of a currency securing and carrying device is disclosed in U.S. Pat. No. 6,357,084. U.S. Pat. No. 6,357,084 discloses a device for securing and carrying currency wherein the device has a strap having a first side, a second side, a first end and a second end, a length, a width and a thickness. The device includes a fastening mechanism having a first element and a second element wherein the first element is located on the second side of the strap proximal to the second end of the strap. The second element is located on the first side of the strap proximal to the first end of the strap. A thumb tab is secured to the strap at or near the first end of the strap and extends outwardly from the strap in the width direction and normal to the length. The currency is folded twice around its vertical width central axis and has cards inserted into the twice-folded currency. The strap extends along the elongated axis of the currency to secure the currency and cards in the device.

U.S. Pat. No. 6,205,622 discloses a method and apparatus for holding paper currency and credit cards. The method disclosed in U.S. Pat. No. 6,205,622 is for holding money and is a money clip or band designed to efficiently accommodate and hold all amounts and quantities of paper currency. The money clip uses a continuous row of outer members and a continuous row of inner members that are interconnected through a linkage system that provides for the longitudinal displacement of the outer member and inner members relative to one another to receive and hold the paper currency inserted therein. The band is very sturdy and flexible to provide for reversibility in that it may be rotated 180 degrees so that either side may be use as the exposed outer display surface. The exposed outer display is presented with an attractive display.

The currency is folded once around its vertical width central axis. The cards are stacked beside the folded currency and the longitudinal axis of the cards are planar with the elongated axis of the currency. The strap extends substantially perpendicular to the elongated axis of the currency and cards to secure the currency and cards in the device.

U.S. Pat. No. 5,367,752 discloses an expandable wrapping ribbon for simply and quickly wrapping packages or securing bundles. The elastic element of the apparatus is hidden and protected by a sheath. Various modes of attaching decorative and identifying items to the apparatus are disclosed. The apparatus is intended to be ornamental as well as functional.

U.S. Pat. No. 5,279,019 discloses a credit card and money-carrying device. The credit card and money carrying device comprises an endless band of elastic material and a plate member folded around the elastic band wherein the plate member is crimped providing engagement of the crimped portion of the plate in the elastic band.

The currency is folded once around its vertical width central axis. The cards are stacked beside the folded currency and the longitudinal axis of the cards are planar with the elongated axis of the currency. The strap extends substantially parallel to the elongated axis of the currency and cards to secure the currency and cards in the device with the free ends of the currency secured by the money carrying device.

An article entitled *The Money Band*, www.moneyband-.com, three (3) pages, Aug. 7, 2006 (the "Moneyband Reference") discloses a money band in the form of a plush, durable band similar to the credit card and money-carrying device disclosed in the U.S. Pat. No. 5,279,019. The credit card and money-carrying device of the Moneyband Reference comprises an endless band of elastic material and a plate member folded around the elastic band.

The currency is folded once around its vertical width central axis. The cards are stacked inside the fold of the folded currency and the longitudinal axis of the cards are planar with the elongated axis of the currency. The endless band of elastic material extends substantially parallel to the elongated axis of the currency and cards to secure the currency and cards in the device with the free ends of the currency secured by the carrying device.

None of the known prior art anticipates, discloses, teaches or suggests a card and currency carrying device comprising a first side member assembly and a spaced second side member assembly and wherein each of the first side member assembly and the second side member assembly have a flexible member having a first end and an opposed second end and wherein each of the flexible members have an undeflected position and a deflected position responsive to a compression deflection force applied concurrently to the first end and the second end of each of the flexible members wherein the flexible members are urged in opposition directions to each other forming a receiving opening, a first pair and second pair of planar support members enclosing each of the flexible members forming each of the first side member assembly and the second side member assembly and a woven, elastic fabric material having a thickness which reduces in dimension in response to a longitudinal tension force and which maintains its width dimension in response to a longitudinal tension force.

None of the known prior art anticipates, discloses, teaches or suggests a preferred embodiment of a card and currency carrying device comprising a pair of spaced, deflectable spring members having an undeflected position and a deflected position responsive to a compression deflection force applied concurrently to the ends of each of the spring members wherein the central sections thereof are urged in opposition directions to each other forming a receiving opening, a first pair of planar support members enclosing one of the deflectable spring members, a second pair of planar support members enclosing the other of the pair of the deflectable spring members and a woven, longitudinally extendable, elastic fabric material having a thickness which reduces in dimension in response to a longitudinal tension force and which maintains the dimension of its width dimension in response to a longitudinal tension force.

BRIEF SUMMARY OF THE INVENTION

The present invention seeks to overcome the problems of the prior art by providing, in its broadest aspect, a card and currency-carrying device comprising a first side member assembly and a spaced second side member assembly. Each of the first side member assembly and the second side member assembly have a flexible member having a first end and an opposed second end. Each of the flexible members have an undeflected position wherein the first end and the second end are generally planar to each other and a deflected position responsive to a compression deflection force applied concurrently to the first end and the second end of each of the flexible members wherein the flexible members are urged in opposition directions to each other forming a receiving opening. A first pair of generally rectangular shaped, planar support member and second pair of generally rectangular shaped, planar support members are operatively connected to each side of and encloses each of the flexible members forming each of the first side member assembly and the second side member assembly. An elastic fabric material, preferably a woven, elastic fabric material, having a thickness which reduces in dimension in response to a longitudinal tension force and which maintains its width dimension in response to a longitudinal tension force is operatively coupled to the first pair and the second pair of support members and each of said flexible members. The elastic fabric material is expanded by a longitudinal tension force in response to a compression deflection source concurrently applied to the first side member assembly and the second side member assembly including the flexible members forming a receiving opening and is contracted back into its original position in response to a compression deflection force being removed from the first side member assembly and the second side member assembly.

In the preferred embodiment, the card and currency carrying device comprises a pair of spaced, opposed, generally rectangular shaped, planar, deflectable spring members having a central section and an elongated central axis. Each of the spring members having a first end and an opposed second end and each have an undeflected position wherein the first end and the second end are generally planar to each other and located along the elongated central axis and a deflected position responsive to a compression deflection force applied concurrently to the first end and the second end of each of the spring members wherein the central sections thereof are urged in opposition directions to each other forming a receiving opening. A first pair of generally rectangular shaped, planar support members are operatively connected on to each side of and encloses one of the pair of spaced, opposed, generally rectangular shaped, planar, deflectable spring members and a second pair of generally rectangular shaped, planar support members are operatively connected on to each side of and encloses the other of the pair of spaced, opposed, generally rectangular shaped, planar, deflectable spring members. A woven, longitudinally extendable, elastic fabric material having a thickness which reduces in dimension in response to a longitudinal tension force and which maintains the dimension of its width dimension in response to a longitudinal tension force is operatively coupled to one of the first pair and the second pair of generally rectangular shaped, planar support members enclosing the pair of spaced, opposed, generally rectangular shaped, planar, deflectable spring members. The woven elastic fabric material is expanded in responsive to a longitudinal tension force generated in response to a compression deflection source being applied to the pair of spaced deflectable spring members urging the central sections thereof in opposition directions to each other forming a receiving opening and is contracted back into its original position in responsive to a compression deflection source being removed from the pair of spaced deflectable spring members forming a clamping force within the space between the pair of spaced deflectable spring members.

Also a method for carrying a card and currency is disclosed and taught by the present invention. The method comprises comprising the steps of: (a) forming a card and currency carrying device having a pair of spaced deflectable spring members wherein each of the spring members having a first end and an opposed second end, each of the spring members have an undeflected position wherein the first end and the second end are generally planar to each other and a deflected position responsive to a compression deflection force applied concurrently to the first end and the second end of each of the spring members wherein deflectable spring members are urged in opposition directions to each other forming a receiving opening, a first pair and second pair of generally rectangular shaped, planar support members operatively connected to each side of and encloses the pair of spaced deflectable spring members and a woven, elastic fabric material, having a thickness which reduces in dimension in response to a longitudinal tension force and which maintains its width dimension in response to a longitudinal tension force wherein an elastic fabric material, preferably woven, elastic fabric material, is operatively coupled to the first pair and the second pair of support members enclosing the pair of spaced deflectable spring members and wherein the woven, elastic fabric material is expanded in response to a compression deflection source being applied to the pair of spaced deflectable spring members forming a receiving opening and is contracted back into its original position in responsive to a compression deflection source being removed from the pair of spaced deflectable spring members; (b) folding at least one item of currency in half along its vertical width center line which is substantially perpendicular to its vertical width central axis and placing in the fold thereof along its central axis at least one card; (c) applying a compression deflection force concurrently to the first end and the second end of each of the spring members wherein deflectable spring members are urged in opposition directions to each other forming a receiving opening; (d) inserting at an angle into the receiving opening the folded at least one item of currency and at least one card located in the fold thereof and positioning the same with its central axis substantially perpendicular to the first pair and the second pair of generally rectangular shaped, planar support members; and (e) removing a compression deflection force applied concurrently to the first end and the second end of each of the spring members wherein deflectable spring members are urged back into its original, generally planar position holding and securing the folded at least one item of currency and at least one card located in the fold thereof.

In use of the card and currency device of the present invention, the currency is folded once around its vertical width central axis. The cards are positioned inside the folded currency and the longitudinal axis of the cards are planar with the elongated axis of the currency. The card and currency carrying device first side member assembly and the second side member assembly extend substantially perpendicular to the elongated axis of the currency and credit cards to secure the currency and cards in the device with the free ends of the currency exposes to the user for ease of removal.

The known prior art does not anticipate, disclose, suggest or teach a simple, easy to use card and currency device comprising a pair of spaced, opposed, deflectable spring members having an undeflected position and a deflected position responsive to a compression deflection force applied concurrently thereto, a first pair of support members operatively connected on to and enclosing one of the pair of spaced, opposed, generally rectangular shaped, planar, deflectable spring members, a second pair of planar support members operatively connected on to and enclosing the other of the pair of spaced deflectable spring members and a woven, longitudinally extendable, elastic fabric material, preferably, a woven, elastic fabric material having a thickness which reduces in dimension in response to a longitudinal tension force and which maintains the dimension of its width dimension in response to a longitudinal tension force.

Therefore, it is an advantage of the present invention to provide a card and currency carrying device having a first side member assembly and second side member assembly, a pair of deflectable spring members having an undeflected position and a deflected position responsive to a compression deflection force applied concurrently thereto operatively connected by an elastic fabric material, which in the preferred embodiment is a woven, longitudinally extendable, elastic fabric material, having a thickness which reduces in dimension in response to a longitudinal tension force and which maintains the dimension of its width dimension in response to a longitudinal tension force.

Another advantage to the present invention is that the card and currency carrying device in use has the currency folded once around its vertical width central axis, the cards are positioned inside the folded currency and the longitudinal axis of the cards are planar with the elongated axis of the currency. The card and currency carrying devices first side member assembly and the second side member assembly extend substantially perpendicular to the elongated axis of the currency and cards to secure the currency and cards in the device with the free ends of the currency exposed to the user for ease of removal.

Another advantage to the present invention is that in one embodiment of the card and currency carrying device the woven, elastic fabric material is formed into pair of fabric material segments each having a selected length and terminating in opposed attachment ends wherein each of the opposed attachment ends are operatively connected to the first end and second end of each of the first pair and second pair of support member which apply a longitudinal tension force to and expand each of the fabric material segments in response to a compression deflection force being applied to the first side member assembly and the second side member assembly.

Another advantage to the present invention is that in another embodiment of the card and currency carrying device the woven, elastic fabric material is formed into an endless loop having a selected diameter and wherein the woven elastic fabric material is positioned to be in operative connection with the first pair and the second pair of support members and the flexible members.

Another advantage to the present invention is that in another embodiment of the card and currency carrying device the woven, elastic fabric material is formed into an endless loop having a selected diameter and wherein the woven, elastic fabric material is positioned to be operative connection to the first pair and said second pair of support members.

Another advantage to the present invention is that in its preferred embodiment the card and currency carrying device flexible members are a pair of spaced deflectable stainless steel spring members.

Another advantage to the present invention is that in the card and currency carrying device the first pair and second pair of generally rectangular shaped, planar support members are leather.

Another advantage to the present invention is that in the card and currency carrying device the first pair and second pair of generally rectangular shaped, planar support members are leather having stitching located around its periphery.

Another advantage to the present invention is that in the card and currency carrying device the flexible members are a pair of spaced deflectable stainless steel spring members and the first pair and second pair of generally rectangular shaped, planar support members are leather which are affixed to the stainless steel spring members using adjustable adhesive, bonding material or glue.

Another advantage to the present invention is that in the card and currency carrying device the first pair and second pair of generally rectangular shaped, planar support members are vinyl.

Another advantage to the present invention is that in the card and currency carrying device the first pair and second pair of generally rectangular shaped, planar support members are cloth.

Another advantage to the present invention is that in the card and currency carrying device is that woven, elastic fabric material is operatively connected to the first pair and the second pair of support members enclosing the pair of spaced deflectable spring members preferably has an overall height of 2 and ⅝ inches to accommodate currency of the United States.

Another advantage to the present invention is that in the card and currency carrying device is that woven, elastic fabric material is operatively connected to the first pair and the second pair of support members enclosing the pair of spaced deflectable spring members and which is selected to have an overall height to accommodate any desired currency.

Another advantage to the present invention is that in the card and currency carrying device is that woven, elastic fabric material is operatively connected to the first pair and the second pair of support members enclosing the pair of spaced deflectable spring members has an overall width in the range of about ½ inch to about 1 and ½ inches.

Another advantage to the present invention is that in the card and currency carrying device is that woven, elastic fabric material operatively connected to the first pair and the second pair of support members enclosing the pair of spaced deflectable spring members has an overall width of about ¾ of an inch.

Another advantage of the present invention is that a card, such as for example a credit card, is inserted into or positioned within the currency which is folded in half along its vertical width central axis with the card extending substantially perpendicular to the central axis and the folded currency and card are positioned with the receiving opening of the card and currency carrying device and a user can remove the card directly from the folded currency and card and currency carrying device without having to remove the currency and card from the card and currency carrying device.

Another advantage to the present invention is a method for using the carrying a card and currency comprising is disclosed.

BRIEF DESCRIPTION OF THE DRAWING

The present invention will become more fully understood from the following detailed description of a preferred but non-limiting embodiment thereof, described in connection with the accompanying drawings, wherein:

FIG. 12 is a cross sectional view of another embodiment of the a card and currency carrying device having a pair of spaced, deflectable spring members each having an undeflected position and a deflected position responsive to a compression deflection force applied concurrently thereto, a first pair and a second pair of planar support members operatively connected on to each side of and enclosing the other of said pair of spaced, deflectable spring members and endless loop of a woven, longitudinally extendable, elastic fabric material having a predetermined length located between each of the outer planar support members and its adjacent deflectable spring forming an operative arrangement there between;

FIG. 13 is a cross-sectional view of yet another embodiment of the a card and currency carrying device having a pair of spaced, deflectable spring members each having an undeflected position and a deflected position responsive to a compression deflection force applied concurrently thereto, a first pair and a second pair of planar support members operatively connected on to each side of and enclosing the other of said pair of spaced, deflectable spring members and endless loop of a woven, longitudinally extendable, elastic fabric material having a predetermined length located between each of the inner planar support member and its adjacent deflectable spring forming an operative arrangement there between;

DETAILED DESCRIPTION OF THE INVENTION

Background

The present fashion trend is for a user to have a single small holder that replaces a conventional wallet or the like. The holder is designed to be small, compact and fashionable for easy use as a credit card and currency carrying device and specifically designed and structured to receive and store one or more cards such as credit cards, identification cards or the like and a desired amount of currency of any country. The design concept is for an acceptable card and currency carrying device that is configured to be sized dimensionally for the specific purpose of being carried in a pocket, purse or other location on the person and a device that is easy to use for both inserting and retrieving a card or currency therefrom and which, during use, effectively stores and hold cards and currency therein.

Preferred Embodiment of Card and Currency Carrying Device

As a result of the above described need, a novel and unique card and currency carrying device and a method of using the same has been developed.

FIGS. 1 through 7 disclose a card and currency-carrying device shown generally as 20 having a first side member assembly 22 and a spaced second side member assembly 24.

Figure 11:
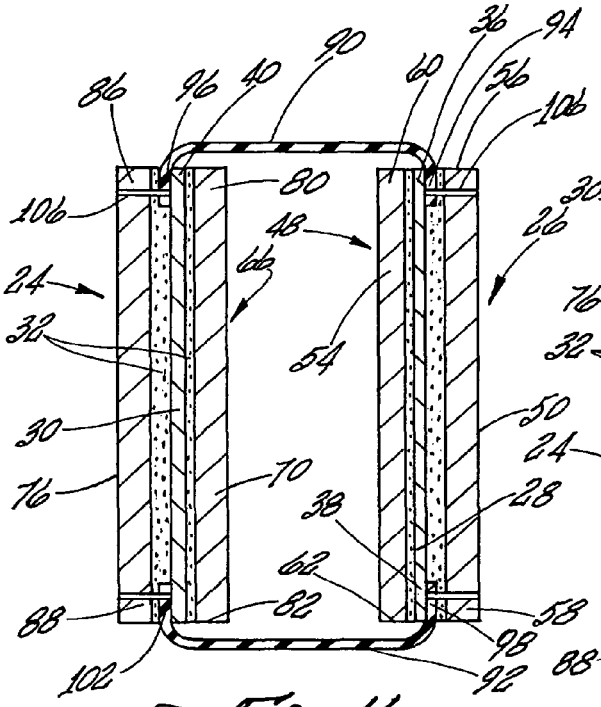
FIG. 11 is a cross-sectional view of the first side member assembly and a second side member assembly of the preferred embodiment of a card and currency carrying device operatively connected by a pair of woven, fabric material segments each having a selected length and terminating in opposed attachment ends.

In this embodiment, the first side member assembly 22 and a spaced second side member assembly 24, are of similar structure. Each of the first side member assembly 20 and the second side member assembly 24 have a flexible member 28 and 30 as shown in FIG. 11. As shown in FIG. 11, the flexible member 28 has a first end 36 and an opposed second end 38. The flexible member 30 has a first end 40 and an opposed second end 42. Each of the flexible members 28 and 30 have an undeflected position wherein the first ends 36 and 40 and the second ends 38 and 42 are generally planar to each other.

In addition, each of the flexible members 28 and 30 have an deflected position wherein the first ends 36 and 40 and the second end 38 and 42 are responsive to a compression deflection force applied concurrently to the first ends 36 and 40 and the second ends 38 and 42 of each of the flexible members 28 and 30 wherein the flexible members 28 and 30 are urged in opposition directions to each other forming a receiving opening shown by arrow 44 as depicted by opening 110 in FIG. 14 C.

In FIGS. 1 through 7, the elastic fabric material is in the form of fabric material segments 90 and 92. Currency is shown as 100 and cards within the fold of the currency is shown as 104.

Figure 1:
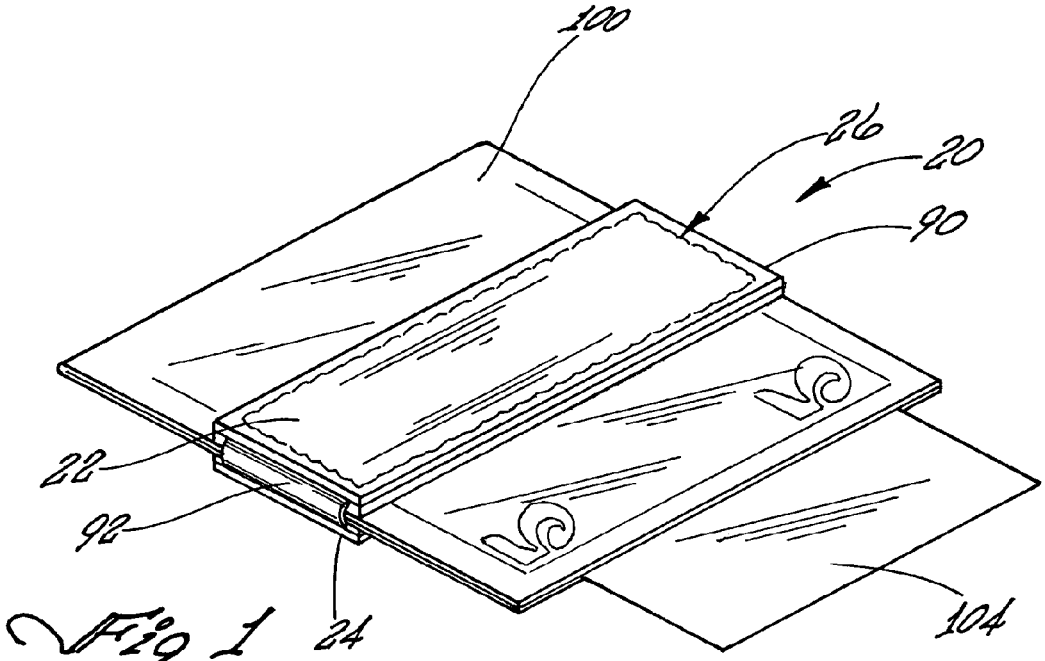
FIG. 1 is a front, bottom and right side perspective view of a card and currency carry device having a first side member assembly and a second side member assembly operatively connected by an elastic fabric material which in the preferred embodiment is a woven, elastic fabric material.
Figure 8:
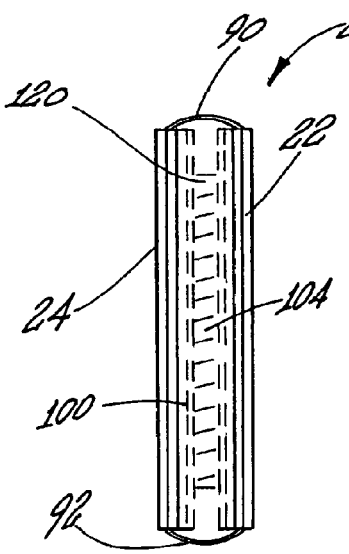
FIG. 8 is a left side elevational view of the card and currency carry device of FIG. 1 showing a card and small amount of folded currency holding a card being stored in the card and currency carry device.

FIG. 8, which is a left side elevational view of the card and currency carry device of FIG. 1, shows by dashed lines 120 a card 104 and small amount of folded currency 100 holding card 104 being stored there between located within and being held by side member assemblies 22 and 24 in the card and currency carry device 20.

Figures 3, 4, 5:
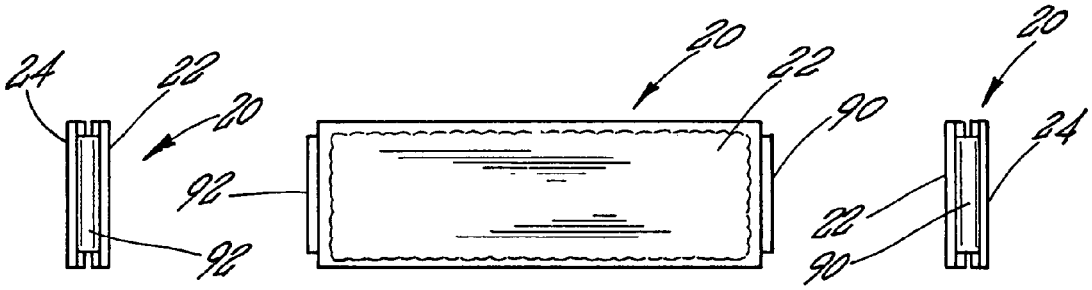
FIG. 3 is a front plan view thereof.
FIG. 4 is a right side elevational view thereof.
FIG. 5 is a left side elevational view thereof.
Figure 6:
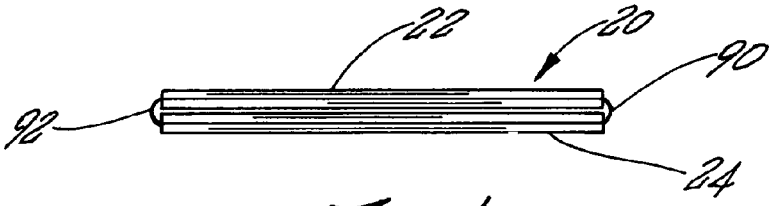
FIG. 6 is a bottom plan view thereof.
Figure 9:
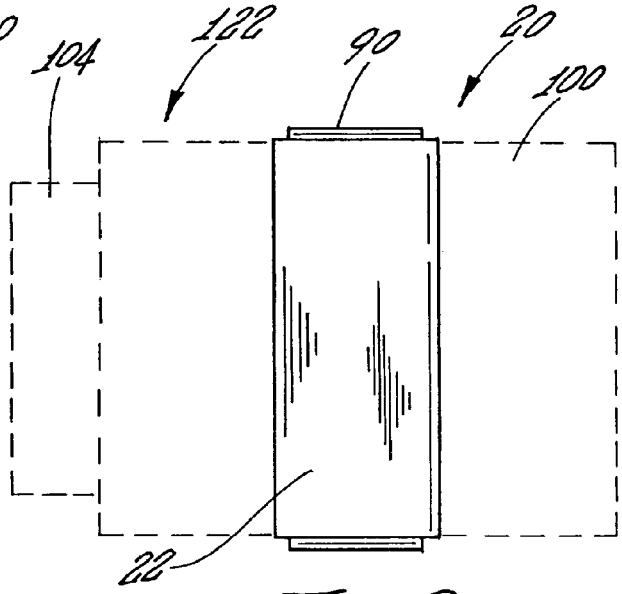
FIG. 9 is a front plan view of the card and currency carrying device of FIG. 3 rotated 90 degrees counterclockwise with the left side being positioned at the bottom location and showing in dashed lines a card and small amount of folded currency of any country secured by the card and currency carrying device.

FIG. 9, which is a front view of the card and currency carrying device 20 of FIG. 3 rotated 90 degrees counterclockwise with the left side being positioned at the bottom location, shows by dashed lines 122 and 124 a small amount of folded currency 100 of any country securing a card 104 in the card and currency carrying device 20.

Figure 10:
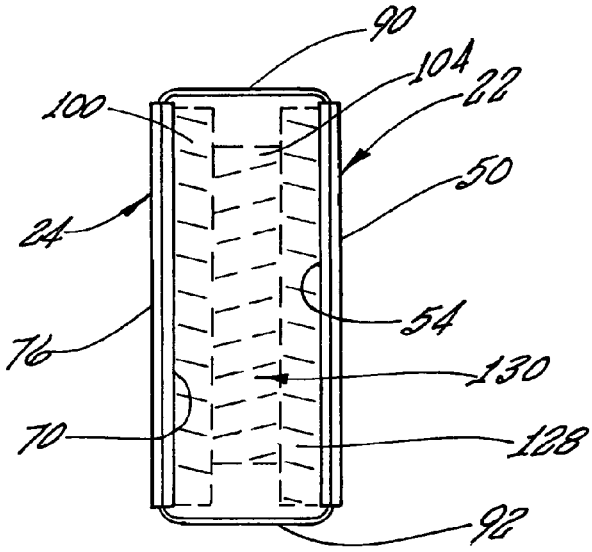
FIG. 10 is a left side elevational view of the card and currency carry device of FIG. 3 rotated to degrees counter clockwise with the left side showing a large number of cards and large amount of folded currency securing the cards being stored in the card and currency carry device.

FIG. 10, which is a left side elevational view of the card and currency carry device 20 of FIG. 1, shows by dashed lines 128 large amount of folded currency 100 securing a large number of cards shown by dashed lines 130 with the cards being stored in the center folded axis of the card and currency carrying device 20.

United States Dollars have an elongated length of about 6.14 inches (about 15.5 cm), a vertical width of about 2.61 inches (about 6.62 cm) and a thickness of about 0.0043 inches (about 0.010 cm).

In the preferred embodiment, the card and currency-carrying device 20 is configured for us with United States Dollars having an elongated length of about 6.14 inches (about 15.5 cm) and a vertical width of 2 and ⅝ inches (about 6.62 cm).

In the preferred embodiment, the woven, elastic fabric material operatively connected to the first pair of support members and the second pair of support members enclosing the pair of spaced deflectable spring members has an overall height of about 2 and ⅝ inches to accommodate United States Dollars.

The width of the card and currency-carrying device 20 of FIGS. 1 through 11 can be selected to be of any desirable width for use. For example, the woven, elastic fabric material operatively coupled to the first pair of support member and the second pair of support members enclosing the pair of spaced deflectable spring members may have an overall width in the range of about ½ inch to about 1 and ½ inches.

In the preferred embodiment, the woven, elastic fabric material operatively coupled to the first pair of support member and the second pair of support members enclosing the pair of spaced deflectable spring members may have an overall width in the range of about ¾ of an inch.

However, it is known that the size and dimensions. e.g. length, width and thickness, of currency of each country can vary. It is within the teachings of the present invention that the woven, elastic fabric material operatively coupled to the first pair of support members and the second pair of support members enclosing the pair of spaced deflectable spring members can be selected to have a selected workable overall height to accommodate the currency of a selected of country. Also, the woven, elastic fabric material operatively connected to the first pair of support member and the second pair of support members enclosing the pair of spaced deflectable spring members can be selected to have an overall width which is useable with the currency of choice.

In FIG. 11, arrow 48 designates a first pair of generally rectangular shaped, planar support members 50 and 54 operatively connected to each side of and enclosing the flexible member 28 forming the first side member assembly 22. Support member 50 has a first end 56 and a second end 58 and support member 54 has a first end 60 and a second end 62.

In FIG. 11, arrow 66 designates a second pair of generally rectangular shaped, planar support members 70 and 76 operatively connected to each side of and enclosing the flexible member 30 forming the second side member assembly 24. Support member 70 has a first end 80 and a second end 82 and support member 76 has a first end 86 and a second end 88.

In FIG. 11, an adhesive bonding or glue material 32 is used to operatively connect the elements or the side member assembled 24 and 26.

Referring now to FIGS. 1 through 7 and FIG. 11, an elastic fabric material is formed into a pair of fabric material segments 90 and 92 each having a selected length and terminating in opposed attachment ends. Fabric material segment 90 terminates in opposed attachment ends 94 and 96 and fabric material segment 92 terminates in opposed attachment ends 98 and 102 as shown in FIG. 11.

Each of the opposed attachment ends 94 and 96 of fabric material segment 90 are operatively connected to the first end 56 of support member 50 and first end 86 of support member 76. Each of the opposed attachment ends 98 and 102 of fabric segment 92 are operatively connected to the second end 58 of support member 50 and the second end 86 of support member 76.

In FIG. 11, the fabric material segments 90 and 92 are stitched as shown by thread 106 to the support members 50 and 76 to provide structural rigidity to the device.

When a compression deflection force is concurrently applied to first ends 56 and 86 and second ends 58 and 88 of side member assemblies 22 and 24, the first pair of support members 50 and 54 and the second pair of support members 70 and 76 apply a longitudinal tension force to and expand each of the fabric material segments 90 and 92 in response to a compression deflection force being applied to the first side member assembly 20 and the second side member assembly 22.

In the preferred embodiment, the elastic fabric material segments 90 and 92, as shown in greater detail in FIG. 11, are a woven, elastic fabric material having a thickness which reduces in dimension in response to a longitudinal tension force and which maintains its width dimension in response to a longitudinal tension force. The woven, elastic fabric material segments 90 and 92 are expanded by a longitudinal tension force in response to the compression deflection source concurrently being applied to the first side member assembly 22 and the second side member assembly 24 including the flexible members 28 and 30 forming the receiving opening 110, as shown in FIG. 14 C, and contracting the woven, elastic fabric material segments 90 and 92 back into its original position in response to a compression deflection force being removed from said first side member assembly and said second side member assembly.

Figure 12:
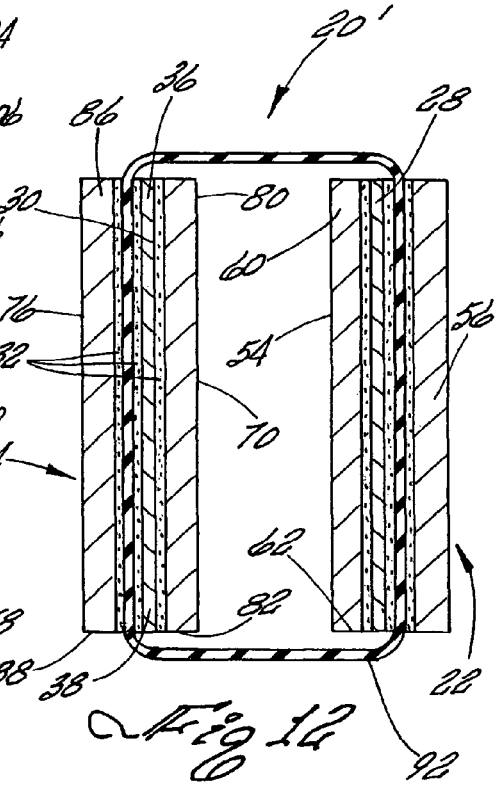

FIG. 12 is a cross-sectional view of another embodiment of the a card and currency carrying device 20' having a pair of spaced, deflectable spring members 28 and 30 each having an undeflected position and a deflected position responsive to a compression deflection force applied concurrently thereto. The device 20' includes a first pair of planar support members 50 and 54 and a second pair of planar support members 70 and 76 which are structurally similar to the same elements depicted in FIG. 11 for device 20. The first pair of planar support members 50 and 54 and a second pair of planar support members 70 and 76 are operatively connected on to each side of and enclosing the other of the pair of spaced, deflectable spring members 28 and 30 and includes an endless loop 90 of a woven, longitudinally extendable, elastic fabric material having a predetermined length located between each of the outer planar support members 50, 54, 70 and 76 and its adjacent deflectable spring 28 and 30. The endless loop 90 of a woven, longitudinally extendable, elastic fabric material is configured to be operatively connected to the outer planar support members 50, 54, 70 and 76 and its adjacent deflectable spring 28 and 30 using an adhesive 32 forming an operative arrangement there between.

Figure 13:
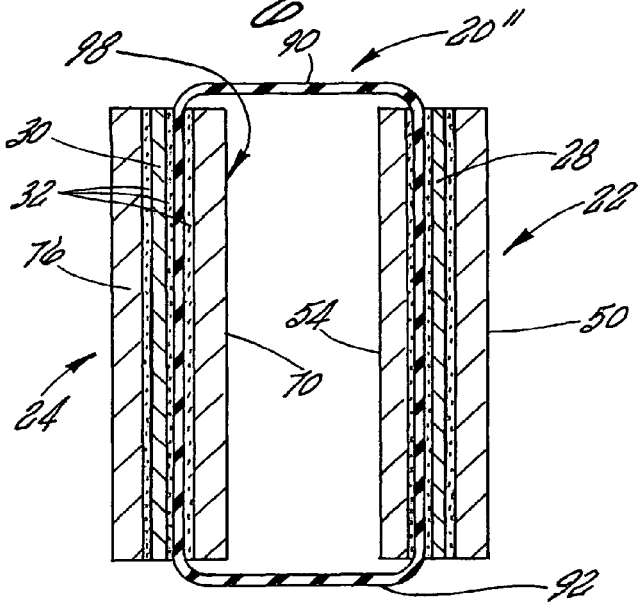

FIG. 13 is a cross-sectional view of yet another embodiment of the a card and currency carrying device 20" having a pair of spaced, deflectable spring members 28 and 30 each having an undeflected position and a deflected position responsive to a compression deflection force applied concurrently thereto. The device 20" includes a first pair of planar support members 50 and 54 and a second pair of planar support members 70 and 76 operatively connected on to each side of and enclosing the other of the pair of spaced, deflectable spring members 28 and 30. An endless loop 96 of a woven, longitudinally extendable, elastic fabric material having a predetermined length is located between each of the inner planar support members 54 and 74 and its adjacent deflectable spring members 28 and 30. In this embodiment, the endless loop 96 of a woven, longitudinally extendable, elastic fabric material can be used in two configurations. In one configuration, the endless loop 96 of a woven, longitudinally extendable, elastic fabric material is configured to be operatively connected relative to the inner planar support members 54 and 70 forming an operative arrangement there between.

In another configuration, the endless loop 96 of a woven, longitudinally extendable, elastic fabric material is configured to be operatively connected to the inner support members 54 and 70. forming an attachment arrangement there between.

In the embodiment of FIG. 11, as an example, the first pair of generally rectangular shaped, planar support members 50 and 54 are operatively connected using an adhesive 32 to each side of and enclosing the flexible member 28 forming the first side member assembly 22. Support member 50 has a first end 54 and a second end 58 and support member 54 has a first end 60 and a second end 62.

Figure 2:
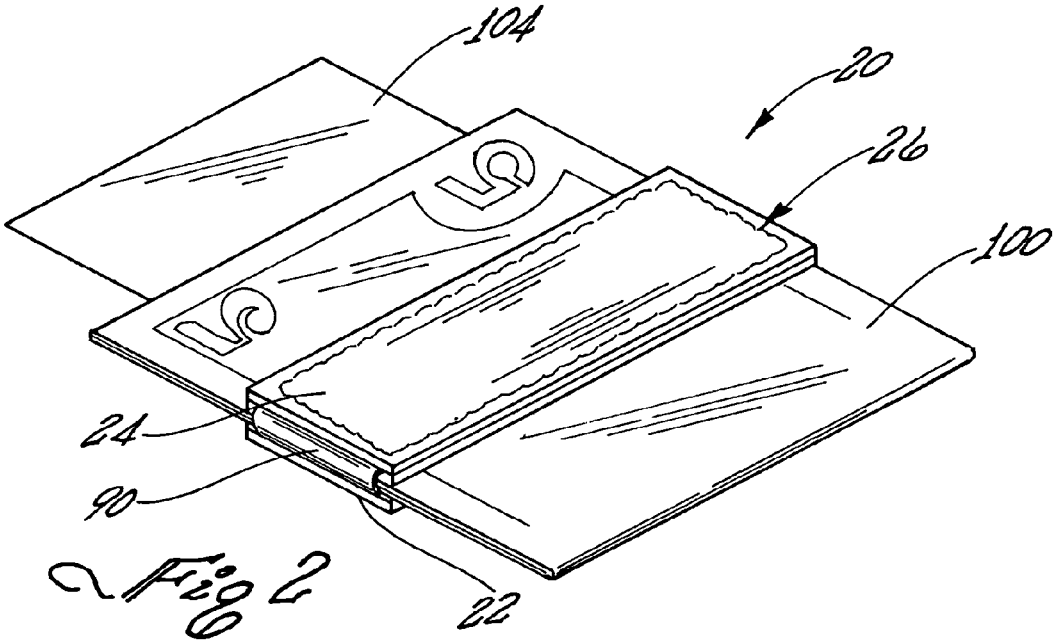
FIG. 2 is a back, top and left side perspective view of the card and currency carry device of FIG. 1.
Figure 7:
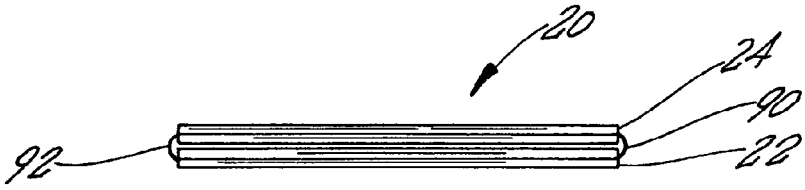
FIG. 7 is a top plan view thereof.

In FIG. 11, the support members 50 and 76 are made of leather material or fabric to give the appearance of a wallet or billfold type structure. As shown in FIGS. 1 and 2, a sown edging depicted by arrow 26 provides a decorative, finished appearance on the leather. The sown edging depicted by arrow 26 can be decorative only and not actually used to join the support member 50 to its adjacent support member 54 or the sown edging depicted by arrow 26 can be used to join the support member 50 its to its adjacent support member 76. In addition and in order to provide for a more durable device an appropriate adhesive, bonding or glue material or glue material can be used In lieu of stitching shown by arrow 26, alternate attaching devices or techniques can be use to join the structure. For example, fasteners, rivets, a screw and fastener assembly or an appropriate glue of adhesive applied to the fasteners as well could be used. Examples of adhesives that could be used as an adhesive are as follows: (1) Resilor Brand Adhesive for porous substrates, manufacturer by Resinova Chemie Ltd., Kanpur, India; (2) Resibond 3010, high quality multipurpose neutral curse silicone sealant manufactured by Resinova Chemie Ltd., Kanpur, India; and (3) Bostik Contact Bond manufactured by Bostik.

Such adhesives can be used to bond or laminate the support members 50 and 54 to the flexible member 28 and to each other to support members 70 and 76 to the flexible member 30.

In the alternative, the exterior surfaces of support members 50, 54, 70 and 76 can have an external surface formed of other known materials to give a desired decorative appearance including, without limitation, finishing materials such as vinyl, cloth, plastic or other coating materials known to persons skilled in the art for use on accessory items.

It is envisioned that the card and currency-carrying device can be fabricated as a decorative accessory item. The decorative appearance can be obtained by a variety of techniques and by use of fabrics, color coating materials and the like. For example, the leather support member can be a dark color, e.g. black or brown, or the stitching can be a contrasting color. The exterior of the support member can be fabricated using a colored material, e.g. a fabric dyed or colored in "hot pink" to give a desire effect. The exterior surface of the device can be imaged, printed or embossed in the form of a trademark affixed to the device.

The elastic fabric material, preferably a woven elastic fabric material, can be formed of various weaves and material as, such as for example and without limitation, cotton gabardine, light weight polyester and cotton insert type plastic, nylon webbing, or other special constructions including rubber (considered herein as an elastic fabric material), which exhibit the characteristic of an elastic fabric material having a thickness which reduces in dimension in response to a longitudinal tension force and which maintains its width dimension in response to a longitudinal tension force.

The functional flexible members which have a first end and an opposed second end, a undeflected position and a deflected position responsive to a compression deflection force applied concurrently to the first end and the second end of each of the flexible members wherein the flexible members are urged in opposition directions to each other forming a receiving opening can be used.

In the preferred embodiment the flexible member is formed of blue finished and polished 1095 spring steel, 0.008" thickness which is available in various widths. In the preferred embodiment, the width used was 0.75 inches. The above is one example of a stainless steel that can be used in practicing this invention. It is envisioned that other stainless steel members or other spring steel members can be use which functionally meet the above-described criteria.

FIGS. 14A, 14B, 14C and 14D illustrate a method for using the card and currency devices depicted in FIGS. 1 through 13.

Figure 14A:
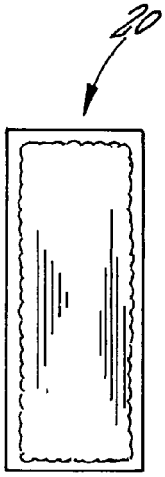
FIG. 14A is a front view of the card and currency carrying device rotated 90 degrees counterclockwise with the left side being positioned at a bottom location and in position for a user to perform the step of inserting folded currency of any country and a card to be secured by the card and currency carrying device.

FIG. 14A illustrates that the card and currency carrying device 20 of FIGS. 1 through 7 is rotated 90 degrees counterclockwise with the left side being positioned at a bottom location and in position for a user to perform the step of inserting folded currency of any country and a card to be secured by the card and currency carrying device.

Figure 14B:
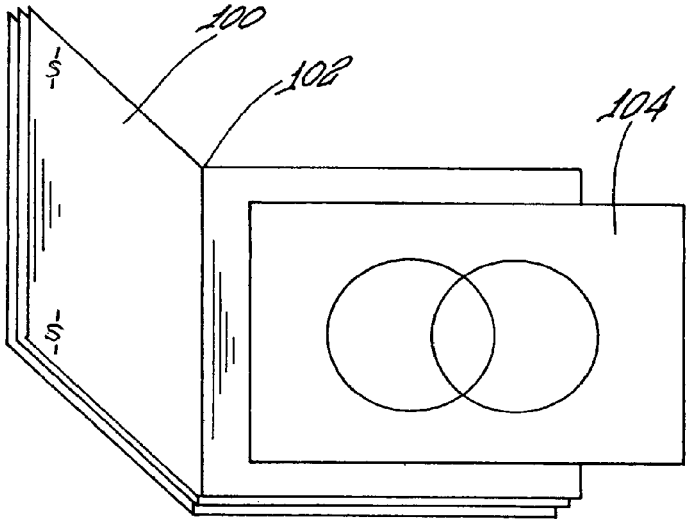
FIG. 14B illustrates the step of folding currency once along it vertical width central axis and inserting in the fold a credit card that extends substantially parallel to the elongated central axis of the currency.

FIG. 14B illustrates the step of folding currency 100 once along it vertical width central axis 102 and inserting in the fold a credit card 104 that extends substantially parallel to the elongated central axis of the currency 100.

Figure 14C:
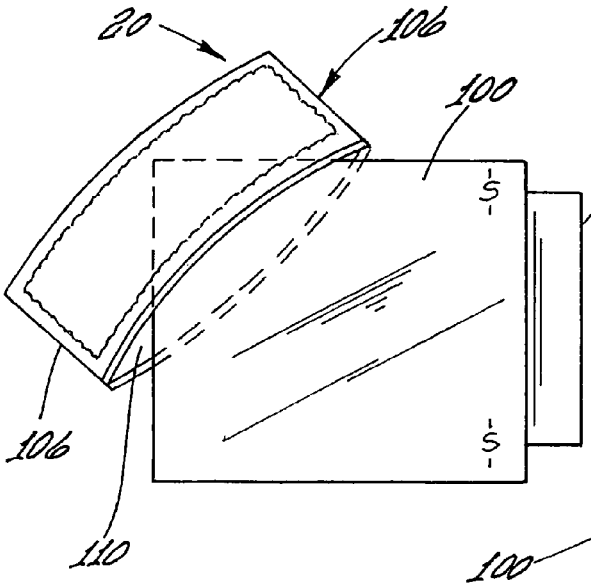
FIG. 14C illustrates the step of a user applying a compression deflection force between the ends of the card and currency carrying device forming a receiving opening between the side member assemblies and the step of inserting in the receiving open at a slight angle the once folded currency and the credit card that extends substantially parallel to the elongated central axis of the currency.

FIG. 14C illustrates the step of a user applying a compression deflection force 106 between the ends of the card and currency carrying device 20 forming a receiving opening 110 between the side member assemblies and the step of inserting in the receiving open 110 at a slight angle the once folded currency 100 and the credit card 104 that extends substantially parallel to the elongated central axis of the currency 100.

Figure 14D:
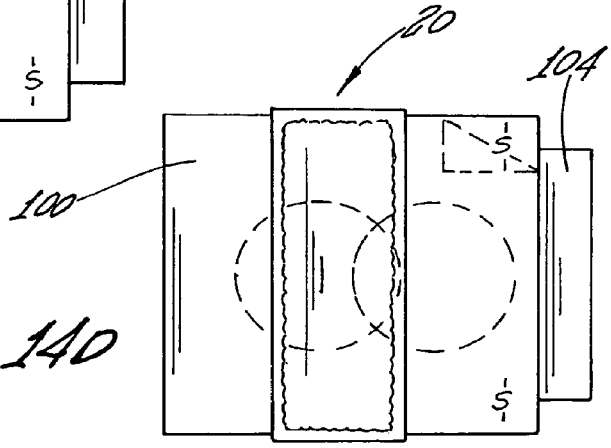
FIG. 14D illustrates the step of a user removing the compression deflection force between the ends of the card and currency carrying device urging the side member assemblies into their undeflected position securing the once folded currency and the credit card that extends substantially parallel to the elongate central axis of the currency.

FIG. 14D illustrates the step of a user removing the compression deflection force 106 between the ends of the card and currency carrying device 20 urging the side member assemblies into their undeflected position securing the once folded currency 100 and the credit card 104 that extends substantially parallel to the elongate central axis of the currency.

The method discloses and teaches a method for using a card and currency-carrying device of the present invention. The method comprising the steps of: (a) forming a card and currency carrying device having a pair of spaced deflectable flexible member such as spring members, each of the spring members having a first end and an opposed second end, each of the spring members having an undeflected position wherein the first end and the second end are generally planar to each other and a deflected position responsive to a compression deflection force applied concurrently to the first end and the second end of each of the spring members wherein deflectable spring members are urged in opposition directions to each other forming a receiving opening; a first pair and second pair of generally rectangular shaped, planar support members operatively connected to each side of and enclosing the pair of spaced deflectable spring members; and an elastic fabric material, preferably as woven, elastic fabric material having a thickness which reduces in dimension in response to a longitudinal tension force and which maintains its width dimension in response to a longitudinal tension force, the woven, elastic fabric material being operatively connected to the first pair and the second pair of support members enclosing the pair of spaced deflectable spring members wherein the woven, elastic fabric material is expanded in response to a compression deflection source being applied to the pair of spaced deflectable spring members forming a receiving opening and contracting the woven, elastic fabric material back into its original position in responsive to a compression deflection source being removed from the pair of spaced deflectable spring members; (b) folding at least one item of currency in half along its vertical width center line which is substantially perpendicular to its central axis and placing in the fold thereof along its central axis at least one card; (c) applying a compression deflection force concurrently to the first end and the second end of each of the flexible members, e.g., spring members, wherein deflectable spring members are urged in opposition directions to each other forming a receiving opening; (d) inserting at an angle into the receiving opening the folded at least one item of currency and at least one card located in the fold thereof and positioning the same with its central axis substantially perpendicular to the first pair and second pair of generally rectangular shaped, planar support members; and (e) removing a compression deflection force applied concurrently to the first end and the second end of each of the spring members wherein deflectable spring members are urged back into its original, generally planar position clamping and securing the folded at least one item of currency and at least one card located in the fold thereof.

The method for using the card and currency carrying device step of forming includes the woven, elastic fabric material being formed into an endless loop having a selected diameter and wherein the woven, elastic fabric material is operatively connected with the first pair and the second pair of support members enclosing the pair of spaced deflectable spring members.

The method for using the card and currency carrying device step of forming includes the woven, elastic fabric material being formed into an endless loop having a selected diameter and wherein the woven, elastic fabric material being is operatively connected to the first pair and the second pair of support members enclosing the pair of spaced deflectable spring members.

The method for using the card and currency carrying device step of forming includes the first pair and the second pair of support members enclosing the pair of spaced deflectable spring members are formed of leather material.

The method for using the card and currency carrying device step of forming includes the first pair and the second pair of support members enclosing the pair of spaced deflectable spring members are formed of a vinyl material.

The method for using the card and currency carrying device step of forming includes the first pair and the second pair of support members enclosing the pair of spaced deflectable spring members are formed of a cloth material.

The method for using the card and currency carrying device step of forming includes the pair of spaced deflectable spring members being formed of stainless steel.

It is envisioned that the card and currency carrying device can be structured or configured in other sizes, shapes and dimensions and the method can be used in for other carrying devices, such as, without limitation, boxes, gifts or packages other than currency and cards. It will be appreciated that various alterations and modifications may be made to the card and currency carrying device and method to enhance the functional characteristics thereof. All such variations and modifications should be considered to fall within the scope of the invention as broadly hereinbefore described and as claimed hereafter.

It is claimed:

1. A device comprising:

two spaced, opposed, planar, deflectable spring members having a central section and an elongated central axis, each of the spring members having a first end and an opposed second end, each of the spring members having an undeflected position wherein the first end and the second end are generally planar to each other and located along the central axis and a deflected position responsive to a compression deflection force applied concurrently to the first end and the second end of each of the spring members wherein the central sections thereof are urged in opposing directions to each other forming a receiving opening;

a first pair of planar support members operatively connected to each side of and enclosing one of the deflectable spring members;

a second pair of planar support members operatively connected on to each side of and enclosing the other of the deflectable spring members; and a longitudinally extendable, elastic member having a thickness which reduces in dimension in response to a longitudinal tension force and which maintains the dimension of its width dimension in response to a longitudinal tension force, the elastic member being operatively coupled to one of the first pair and the second pair of support members;

wherein the elastic member is expanded in response to a longitudinal tension force generated in response to a compression deflection source being applied to the spring members urging the central sections thereof into opposing directions to each other forming a receiving opening and contracting the elastic member back into its original position responsive to a compression deflection source being removed from the spring members forming a clamping force within the space between the spring members.

2. The device of claim 1 wherein the elastic member is formed into an endless loop and wherein the elastic member is operatively connected with the first pair of support members and the second pair of support members and the pair of spaced deflectable spring members.

3. The device of claim 1 wherein the first pair of support members and the second pair of support members are formed of leather material.

4. The device of claim 1 wherein the elastic member has an overall width in the range of about ½ inch to about 1 and ½ inches.

5. A device comprising:

a first side member assembly and a spaced second side member assembly, each of the first side member assembly and the second side member assembly having a flexible member having a first end and an opposed second end, each of the flexible members having an undeflected position wherein the first end and the second end are generally planar to each other and a deflected position responsive to a compression deflection force applied concurrently to the first end and the second end of each of the flexible members wherein the flexible members are urged in opposing directions to each other forming a receiving opening;

a first pair of planar support members and a second pair of planar support members operatively connected to each side of and enclosing each of the flexible members forming each of the first side member assembly and the second side member assembly; and an elastic member having a thickness which reduces in dimension in response to a longitudinal tension force and which maintains its width dimension in response to a longitudinal tension force, the elastic member being operatively coupled to the first pair of support members and the second pair of support members and each of the flexible members, wherein the elastic member is expanded by a longitudinal tension force in response to a compression deflection source concurrently applied to the first side member assembly and the second side member assembly including the flexible members forming a receiving opening and contracting the elastic fabric material back into its original position in response to a compression deflection force being removed from the first side member assembly and the second side member assembly.

6. The device of claim 5 wherein the elastic member is a woven, elastic fabric material formed into a pair of fabric material segments.

7. The device of claim 5 wherein the elastic member is an endless loop operatively connected to the flexible members.

8. The device of claim 5 wherein the elastic member is an endless loop operatively connected to the first pair and the second pair of support members.

9. The device of claim 5 wherein the flexible members are spring steel.

10. The device of claim 5 wherein the support members are leather.

* * * * *